US006095873A

United States Patent [19]

Muramatsu et al.

[11] Patent Number: 6,095,873

[45] Date of Patent: Aug. 1, 2000

[54] FEMALE TERMINAL

[75] Inventors: Kenji Muramatsu; Tsuyoshi Hamai, both of Shizuoka, Japan

[73] Assignee: Yazaki Corporation, Tokyo, Japan

[21] Appl. No.: 09/238,981

[22] Filed: Jan. 28, 1999

[30] Foreign Application Priority Data

Jan. 29, 1998 [JP] Japan ..... 10-017175

[51] Int. Cl.[7] ..... H01R 11/22

[52] U.S. Cl. ..... 439/852

[58] Field of Search ..... 439/387, 436, 439/437, 845, 852, 862, 856, 857

[56] References Cited

U.S. PATENT DOCUMENTS

| | | | |
|---|---|---|---|
| 3,918,784 | 11/1975 | Lemke et al. | 439/387 |
| 5,601,458 | 2/1997 | Ohsumi et al. | 439/852 |
| 5,624,289 | 4/1997 | Kourimsky et al. | 439/852 |
| 5,702,272 | 12/1997 | Machida | 439/852 |
| 5,707,259 | 1/1998 | Ishizuka et al. | 439/852 |
| 5,769,673 | 11/1998 | Ohta et al. | 439/852 |
| 5,775,962 | 7/1998 | Kakuta et al. | 439/852 |
| 5,857,857 | 1/1999 | Fakuma | 439/862 |

FOREIGN PATENT DOCUMENTS

| | | | |
|---|---|---|---|
| 4-36969 | 2/1992 | Japan | 439/437 |

*Primary Examiner*—Brian Sircus
*Assistant Examiner*—J. F. Duverne
*Attorney, Agent, or Firm*—Sughrue, Mion, Zinn, Macpeak & Seas, PLLC

[57] ABSTRACT

A female terminal (1) for electrically connecting with a male terminal (40) comprises a box-shaped electrical connection portion, (10) a first resilient contact piece (13) integrally formed on one of an inner face of a bottom wall (3) of the electrical connection portion (10) and an inner face of a top wall (4) of the electrical connection portion, (10) a second resilient contact piece (23) integrally formed on one of the inner face of the bottom wall (3) and the inner face of the top wall, (4) the second resilient contact piece (23) arranged so as to separate from the first resilient contact piece, (13) and a first indent (14) formed on a free end portion (13) of the first resilient elastic contact piece (14) for peeling off an oxide film adhering to the male terminal (40).

4 Claims, 4 Drawing Sheets

FEMALE TERMINAL

BACKGROUND OF THE INVENTION

The present invention relates to a female terminal which is electrically connected by removing an oxide film adhering to a male terminal.

There is proposed a female terminal 50 such as the one shown in FIG. 6.

This female terminal 50 is comprised of a box-type electrical contact portion 53 in which one end portion of a base plate 51 is formed as a bottom wall 52, an electrical connection portion 54 for connecting an electric wire (not shown) to the other end portion of the base plate 51, and a resilient contact piece 55 disposed inside the electrical contact portion 53. A front retaining piece 56*a* and a rear retaining piece 56*b* are formed by folding back one end portion and the other end portion of the bottom wall 52, respectively. The tongue-shaped resilient contact piece 55 extends between the front retaining piece 56*a* and the rear retaining piece 56*b*. The resilient contact piece 55 and a tab-like contact portion (not shown) of a male terminal inserted through an opening 53*a* in the electrical contact portion 55 are electrically connected. Incidentally, the same is the case with a resilient contact piece (not shown) which is folded back into the electrical contact portion 53 from one end of the bottom wall 52.

However, in a case where an oxide film adheres to the tab-like contact portion, there is the risk of occurrence of a faulty electrical contact between the resilient contact piece 55 and the tab-like contact portion due to the oxide film.

SUMMARY OF THE INVENTION

In view of the above-described problem, an object of the present invention is to provide a female terminal which is capable of positively establishing electrical contact by removing an oxide film adhering to a male terminal.

In order to achieve the above object, there is provided a female terminal for electrically connecting with a male terminal comprising: a box-shaped electrical connection portion; a first resilient contact piece integrally formed on one of an inner face of a bottom wall of the electrical connection portion and an inner face of a top wall of the electrical connection portion; a second resilient contact piece integrally formed on one of the inner face of the bottom wall and the inner face of the top wall, the second resilient contact piece arranged so as to separate from the first resilient contact piece; and a first indent formed on a free end portion of the first resilient elastic contact piece for peeling off an oxide film adhering to the male terminal.

The female terminal may further comprise a second indent formed on a free end portion of the second resilient contact piece so as to project in a direction in which the first indent projects for contacting with that portion of the male terminal on which the oxide film is peeled off by the first indent.

The female terminal may further comprises: a first stopper formed on one of the inner face of the bottom wall and the inner face of the top wall so as to project in the same direction in which the first indent projects to restrict excessive deformation of the first resilient contact piece; and a second stopper formed on one of the inner face of the bottom wall and the inner face of the top wall so as to project in the same direction in which the second indent projects and to restrict excessive deformation in the second resilient contact piece.

DETAILED DESCRIPTION OF THE PREFERRED EMBODIMENTS

Figure 1:
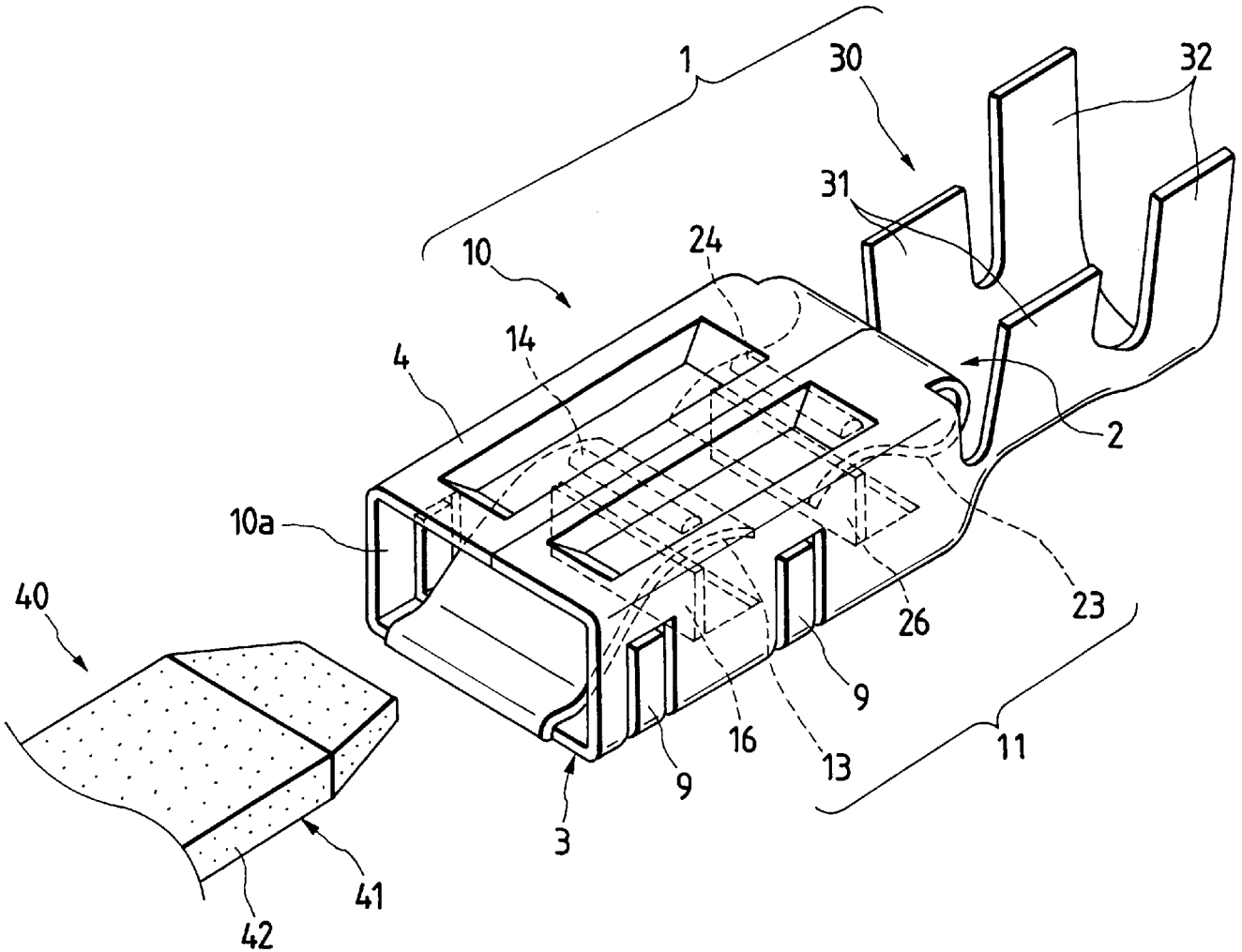
FIG. 1 is a perspective view illustrating one embodiment of a female terminal in accordance with the present invention.

Referring now to the drawings, a description will be given of specific embodiments of the present invention.

FIGS. 1 to 5 show one embodiment a female terminal in accordance with the present invention.

Figure 2:
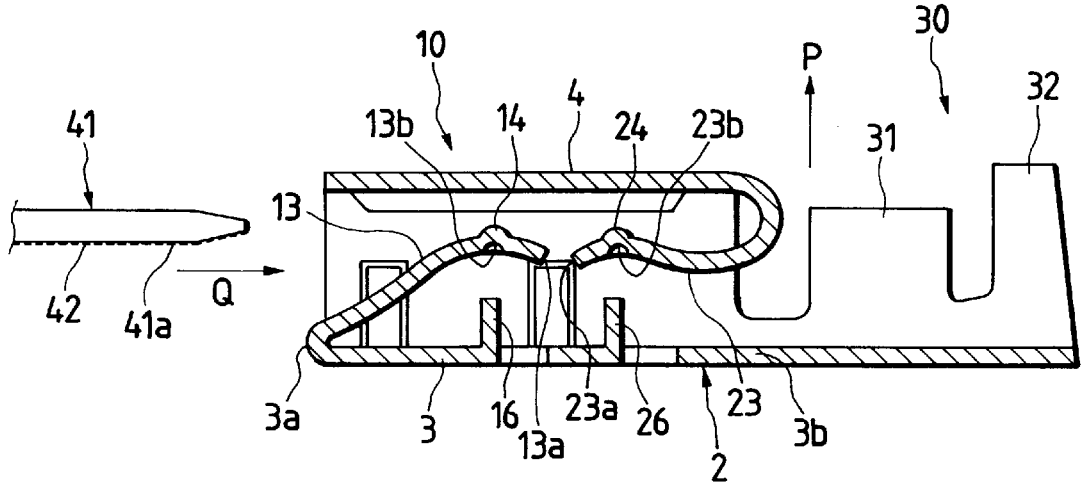
FIG. 2 is a cross-sectional view of FIG. 1.

In FIGS. 1 and 2, this female terminal 1 comprises a box-type electrical contact portion 10 in which an end portion of a base plate 2 is formed as a bottom wall 3, an electrical connection portion 30 for pressing an electric wire (not shown) onto the other end portion of the base plate 2, and a resilient contact member 11 disposed inside the electrical contact portion 10. A tab-like contact portion 41 of a male terminal 40 is inserted through an opening 10*a* at one end of the electrical contact portion 10, and the resilient contact member 11 and the tab-like contact portion 41 are electrically connected.

The resilient contact member 11 is arranged such that a first resilient contact piece 13 is formed by being folded back from one end (distal end) 3*a* of the bottom wall 3, a second resilient contact piece 23 is formed by being folded back from another end (proximal end) 4*b* of a ceiling wall 4, a film peeling-off indent 14 for removing an oxide film 42 is formed projectingly on the first resilient contact piece 13, while a connecting indent 24 for connection to an oxide film-removed portion 43 (see FIG. 3) of the tab-like contact portion 41 is provided on the second resilient contact piece 23. Free ends 13*a* and 23*a* of the first and second resilient contact pieces 13 and 23 are disposed between the bottom wall 3 and the ceiling wall 4 so as not to interfere with each other.

Figure 3:
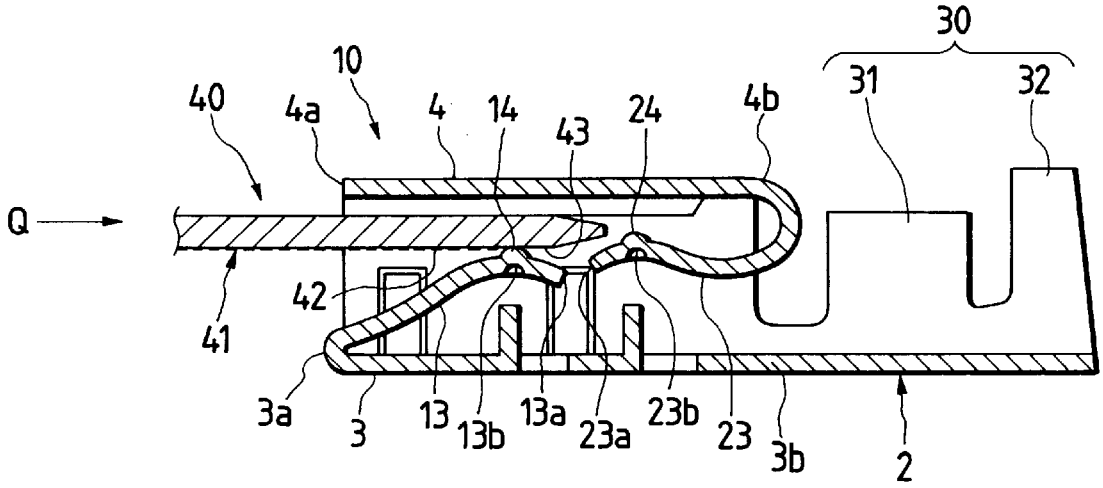
FIG. 3 is a cross-sectional view illustrating a state in which a male terminal is inserted in an electrical contact portion of the female terminal, and a film peeling-off indent is removing an oxide film.
Figure 4:
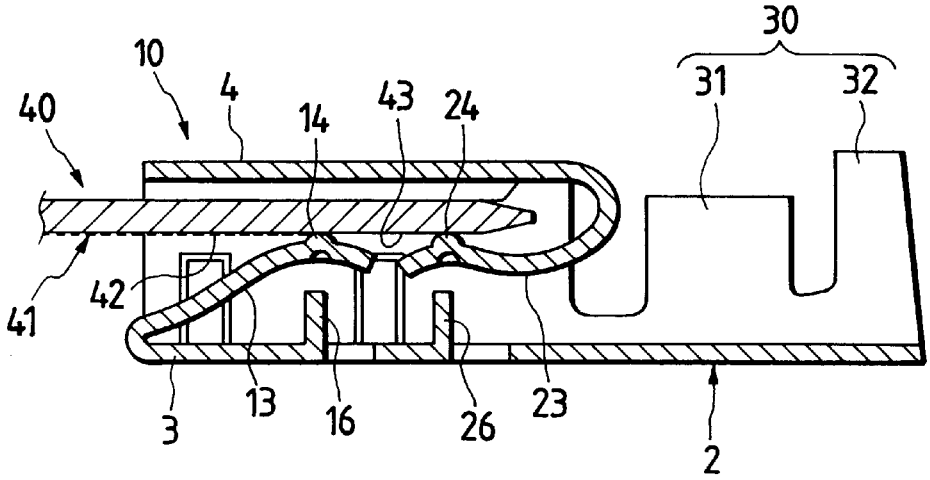
FIG. 4 is a cross-sectional view illustrating a state in which an oxide film-removed portion of the male terminal and a connecting indent are connected.

The first resilient contact piece 13 is folded back from the distal end 3*a* of the bottom wall 3 toward a proximal end 3*b*, extends into the electrical contact portion 10, and has the film peeling-off indent 14 on its free end 13*a* side, i.e., at a contact portion 13*b* of the first resilient contact piece 13 for contacting the tab-like contact portion 41 on the ceiling wall 4 side. The shape of the film peeling-off indent 14 is serrate. Since the first resilient contact piece 13 has resiliency, the film peeling-off indent 14 is urged toward the ceiling wall 4. As shown in FIG. 3, when the tab-like contact portion 41 to which the oxide film 42 adheres is inserted into the electrical contact portion 10, a lower surface 41*a* of the tab-like contact portion 41 slides on the film peeling-off indent 14. As a result, the film peeling-off indent 14 is able to positively remove the oxide film 42 on the tab-like contact portion 41.

As shown in FIGS. 1 and 2, the second resilient contact piece 23 is folded back from the proximal end 4*a* of the ceiling wall 4 toward a distal end 4*b*, extends into the electrical contact portion 10, and has the connecting indent 24 on its free end 23*a* side, i.e., at a contact portion 23*b* of the second resilient contact piece 23 for contacting the tab-like contact portion 41 on the ceiling wall 4 side. The direction in which the connecting indent 24 projects is the same as the direction in which the film peeling-off indent 14 projects (P direction), and the direction in which the connecting indent 24 is arranged is the same as the direction in which the film peeling-off indent 14 is arranged, i.e., in a direction perpendicular to the inserting direction (Q direction) of the tab-like contact portion 41. The shape of the connecting indent 24 is serrate, and its teeth profile is set to be the same as that of the film peeling-off indent 14.

As a result, the oxide film-removed portion 43 of the tab-like contact portion 41 from which the oxide film 42 has been removed by the film peeling-off indent 14 positively is brought into contact with the connecting indent 24 positively. In addition, since the second resilient contact piece 23 has resiliency, the connecting indent 24 is connected to the oxide film-removed portion 43 in a state of being urged toward the ceiling wall 4 by the second resilient contact piece 23.

Returning to FIGS. 1 and 2, a first stopper 16 and a second stopper 26 are raised upward from the bottom wall 3 so as to prevent excessive deformation of the first resilient contact piece 13 and the second resilient contact piece 23. Consequently, after the tab-like contact portion 41 of the male terminal 40 is inserted into the electrical contact portion 10, the first resilient contact piece 13 and the second resilient contact piece 23 can be resiliently restored positively.

Since the first resilient contact piece 13 is used only for the purpose of removing the oxide film 42 adhering to the tab-like contact portion 41, and the second resilient contact piece 23 is used for the purpose of connecting to the oxide film-removed portion 43 (see FIG. 3) of the tab-like contact portion 41, the film peeling-off indent 14 and the connecting indent 24 can be respectively brought into contact (sliding and connection) with the tab-like contact portion 41 independently. As a result, it is possible to prevent the oxide film 42 from being left unremoved from the tab-like contact portion 41 or faulty contact between the oxide film-removed portion 43 and the connecting indent 24. Therefore, even if the oxide film 42 adheres to the male terminal 40, the male terminal 40 and the female terminal 1 can be electrically connected positively, so that the reliability in electrical connection can be improved.

It should be noted that, in the electrical connection portion 30, a pair of core cramping pieces 31 for cramping a core portion of the electric wire (not shown) and a pair of sheath cramping pieces 32 for cramping a sheath of the electric wire are provided uprightly on the other end portion of the base plate 2. In addition, reference numeral 9 denotes a stopper for preventing the lateral offset of the female terminal 1 inserted in a male connector housing (not shown).

Figure 5:
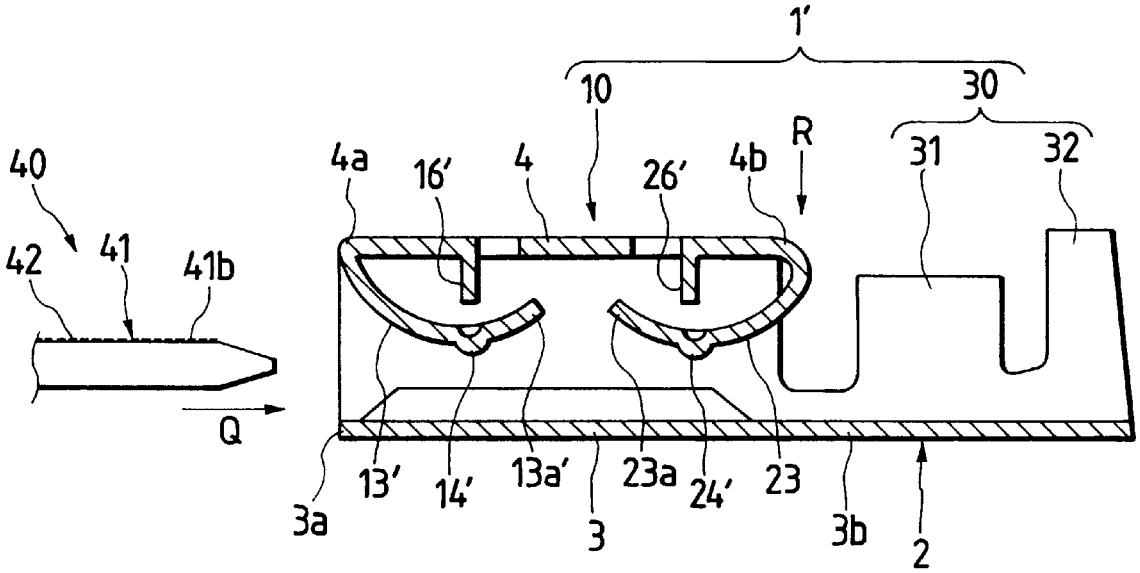
FIG. 5 is a cross-sectional view illustrating a modification of the female terminal.
Figure 6:
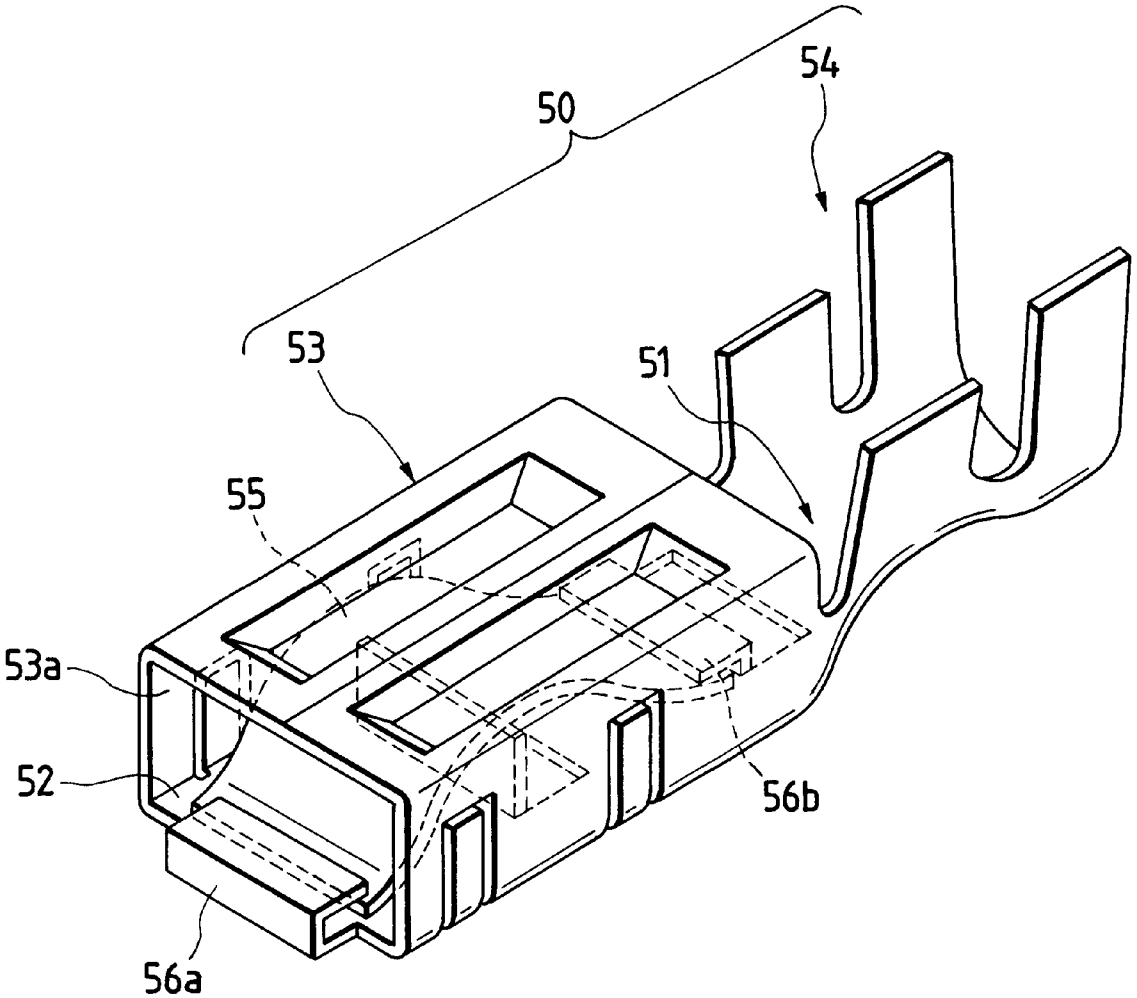
FIG. 6 is a perspective view illustrating a related female terminal.

FIG. 5 shows a modification of the female terminal in accordance with the present invention.

This female terminal 1' is arranged such that a first resilient contact piece 13' is formed inside the electrical contact portion 10 by being folded back from the distal end 4*a* of the ceiling wall 4, and the second resilient contact piece 23 is provided inside the electrical contact portion 10 by being folded back from the proximal end 4*b* of the ceiling wall 4. The first and second resilient contact pieces 13' and 23 are disposed in such a manner that their free ends 13*a'* and 23*a* do not interfere with each other.

A film peeling-off indent 14' projecting toward the bottom wall 3 is provided on the first resilient contact piece 13', while a connecting indent 24' is provided on the second resilient contact piece 23 in such a manner as to project in the same direction as the film peeling-off indent 14'. The shapes and the positions of arrangement of the film peeling-off indent 14' and the connecting indent 24 are substantially the same as those of the film peeling-off indent 14 and the connecting indent 24 of the above-described embodiment, respectively.

A first stopper 16' and a second stopper 26' respectively project from the ceiling wall 4 in the same direction as the projecting direction (R direction) of the film peeling-off indent 14'. The first stopper 26' prevents excessive deformation of the first resilient contact piece 13', and the second stopper 26' similarly prevents excessive deformation of the second resilient contact piece 23. In the modification, an upper surface 41*b* of the tab-like contact portion 41 inserted into the electrical contact portion 10 slides on the film peeling-off indent 14', thereby removing the oxide film 42 adhering to the upper surface 41*b* of the tab-like contact portion 41. Then, the oxide film-removed portion (not shown) of the tab-like contact portion 41 is connected to the connecting indent 24'. It should be noted that although in the embodiment and the modification the second resilient contact piece 23 is formed by being folded back from the proximal end 4*b* of the ceiling wall 4, the second resilient contact piece 23 may be formed by being raised upward from the other end 3*b* of the bottom wall 3.

As has been described heretofore, according to the present invention, in the box-type electrical contact portion which is electrically connected to the male terminal, the first resilient contact piece is formed by being folded back from one end of the bottom wall or the ceiling wall of the electrical contact portion, the second resilient contact piece is formed by being folded back from the other end of the ceiling wall, and the film peeling-off indent is provided projectingly from the free end portion of the first resilient contact piece. As a result, when the male terminal is inserted into the electrical contact portion, the film peeling-off indent is urged toward the male terminal. For this reason, the male terminal slides on the film peeling-off indent. Accordingly, even if a male terminal with an oxide film adhering thereto is used, the oxide film can be removed positively by the film peeling-off indent as the terminal is inserted.

According to the present invention, since the connecting indent is provided at the free end portion of the second resilient contact piece in such a manner as to project in the same direction as the projecting direction of the film peeling-off indent, the oxide film-removed portion of the male terminal with its oxide film removed is electrically connected to the connecting indent reliably. As a result, reliability in electrical connection between the female terminal and the male terminal with the oxide film adhering thereto can be improved.

According to the present invention, since a first stopper and a second stopper are provided on one of the bottom wall and the ceiling wall in such a manner as to project in the same direction as the projecting direction of the film peeling-off indent, it is possible to prevent excessive deformation of the first resilient contact piece and the second resilient contact piece. As a result, it is possible to prevent the oxide film from being left unremoved due to the excessive deformation of the first resilient contact piece, and prevent faulty electrical contact between the male terminal and the connecting indent through the second resilient contact piece.

According to the present invention, since the first resilient contact piece and the second resilient contact piece do not interfere with each other, the displacement of the first resilient contact piece at the time the film peeling-off indent is removing the oxide film from the male terminal and the displacement of the second resilient contact piece at the time when electrical connection is established with the oxide film-removed portion are independent of each other. Consequently, the film peeling-off indent can be made to positively slide on the male terminal, and the connecting indent can be easily connected to the oxide film-removed portion.

What is claimed is:

1. A female terminal for electrically connecting with a male terminal comprising:

a box-shaped electrical connection portion;

a first resilient contact piece integrally formed on a first one of an inner face of a bottom wall of the electrical connection portion and an inner face of a top wall of the electrical connection portion;

a second resilient contact piece integrally formed on a second one of the inner face of the bottom wall and the inner face of the top wall, the second resilient contact piece arranged so as to be separate from the first resilient contact piece, said second one being the same or different than said first one; and a first indent formed on a free end portion of the first resilient elastic contact piece for peeling off an oxide film adhering to the male terminal.

2. The female terminal as set forth in claim 1 further comprising:

a second indent formed on a free end portion of the second resilient contact piece so as to project in a direction in which the first indent projects for contacting with that portion of the male terminal the oxide film which is peeled off by the first indent.

3. The female terminal as set forth in claim 2 further comprising:

a first stopper formed on one of the inner face of the bottom wall and the inner face of the top wall so as to project in the same direction in which the first indent projects to restrict excessive deformation of the first resilient contact piece; and a second stopper formed on said one of the inner face of the bottom wall and the inner face of the top wall so as to project in the same direction of which the second indent projects to restrict excessive deformation of the second resilient contact piece.

4. The female terminal as set forth in claim 2, wherein the said first and second indent have a serrated shape.

* * * * *